US012000593B1

(12) United States Patent
Cantelar

(10) Patent No.: US 12,000,593 B1
(45) Date of Patent: Jun. 4, 2024

(54) TELESCOPIC FIRE PIT

(71) Applicant: Eduardo M Cantelar, Miami, FL (US)

(72) Inventor: Eduardo M Cantelar, Miami, FL (US)

( * ) Notice: Subject to any disclaimer, the term of this patent is extended or adjusted under 35 U.S.C. 154(b) by 0 days.

(21) Appl. No.: 18/436,556

(22) Filed: Feb. 8, 2024

(51) Int. Cl.
*A47J 37/07* (2006.01)
*F24B 13/00* (2006.01)
*F24C 1/16* (2021.01)

(52) U.S. Cl.
CPC ..... *F24C 1/16* (2013.01); *F24B 13/008* (2013.01)

(58) Field of Classification Search
CPC ..... F24C 1/16; F24B 13/008
USPC ..... 126/9 B
See application file for complete search history.

(56) References Cited

U.S. PATENT DOCUMENTS 1,485,292 A * 2/1924 Popper ..... A61L 2/07 126/369
1,934,339 A * 11/1933 Winberg ..... A01G 13/06 126/25 B
2,798,476 A * 7/1957 Marion, Jr. ..... F24C 3/14 126/38
RE26,123 E * 12/1966 Davis ..... A47J 37/0704 126/25 R
4,185,748 A * 1/1980 Vache ..... A47J 36/26 206/509
4,909,235 A * 3/1990 Boetcker ..... A47J 37/0704 126/25 C
6,314,955 B1 * 11/2001 Boetcker ..... A47J 37/0763 126/38
6,557,546 B1 * 5/2003 Gibbons ..... A47J 37/0713 126/41 R
2004/0000303 A1 * 1/2004 Regen ..... A47J 37/0731 126/25 R
2014/0345594 A1 * 11/2014 Rhodes ..... A47J 37/0704 126/25 R
2019/0313851 A1 * 10/2019 Shemp ..... A47J 37/0718
2020/0015626 A1 * 1/2020 Corso ..... A47J 37/0704
2022/0167790 A1 * 6/2022 Hipp ..... A47J 27/13

* cited by examiner

*Primary Examiner* — Avinash A Savani
(74) *Attorney, Agent, or Firm* — Ruben Alcoba, Esq.

(57) ABSTRACT

A collapsible fire pit that is easy to transport and store. The collapsible fire pit comprises a ring base. A first ring that extends upward from the ring base. And, a second ring that extends upward from the first ring. The collapsible firepit uses L-Shaped guides and pins to secure and collapse.

5 Claims, 3 Drawing Sheets

TELESCOPIC FIRE PIT

CROSS REFERENCE

This application is a Continuation of U.S. Ser. No. 18/161,078, filed Jan. 29, 2023, now U.S. patent Ser. No. 11/655,981, the contents of which are incorporated by reference.

TECHNICAL FIELD

The present invention pertains to a collapsible fire pit that is easy to transport.

BACKGROUND

The inventor of the present invention is an avid outdoorsman who loves taking cross country trips in his vehicle.

One of the biggest problems that he has suffered in his trips is having to set up a grill and break up a grill to nourish himself, and then to stow the grill after it use. Usually when stowing the grill, either himself or his vehicle get filthy during the process.

Another problem that he suffers on his road trips is that when he takes a grill, the grill is an unstable structure that tends to fall over in his vehicle.

Yet another problem he experiences when camping is freezing temperatures when he hikes away from his vehicle. Often, he is forced to dig holes in the ground to create fire pits in desolate areas to warm himself.

Because of the above mentioned problems, the inventor conceived the present invention, a lightweight, collapsible fire pit, that could also work as an outdoor cooking grill that is easy to transport.

The present invention is designed, when collapsed, to be easily attachable to a backpack. It is also designed, when it is collapsed, to be placed flat on a vehicle structure.

SUMMARY

The present invention is directed to a collapsible fire pit that is easy to transport. The invention uses a telescopic mechanism that is comprised of L-shaped guides and pins to collapse into itself.

The collapsible fire pit comprises a ring base. A first annular ring that extends upward from the ring base. And, a second annular ring that extends upward from the first annular ring. The collapsible firepit uses L-Shaped guides and pins to secure and collapse into itself. Hereinafter the term collapsible and telescopic shall be used synonymously.

An object of the present invention is to provide a collapsible travel pit that can easily be stored in a vehicle.

Another object of the present invention is to provide a collapsible fire pit that can be used as an emergency stove.

Yet another object of the present invention is to provide a collapsible fire pit that is easy to stow in a backpack.

Yet still another object of the present invention is to provide a tactical collapsible fire pit that can be used by military personnel when on clandestine missions.

A further object of the present invention is to provide a collapsible fire pit that can be laid flat in a transport vehicle and that will not flip while in transport.

Yet a further object of the present invention is to provide a collapsible fire pit that will prevent animals from getting injured if they inadvertently touch the outer walls of the pit when the pit is burning a combustible material.

Yet still a further object of the present invention is to provide a camper with a fire pit that can easily be transported and stowed after use that will not dirty the transport vehicle.

DRAWINGS

These and other features, aspects, and advantages of the present invention will become better understood with regards to the following description, appended claims, and drawings where:

DESCRIPTION

Figure 1:
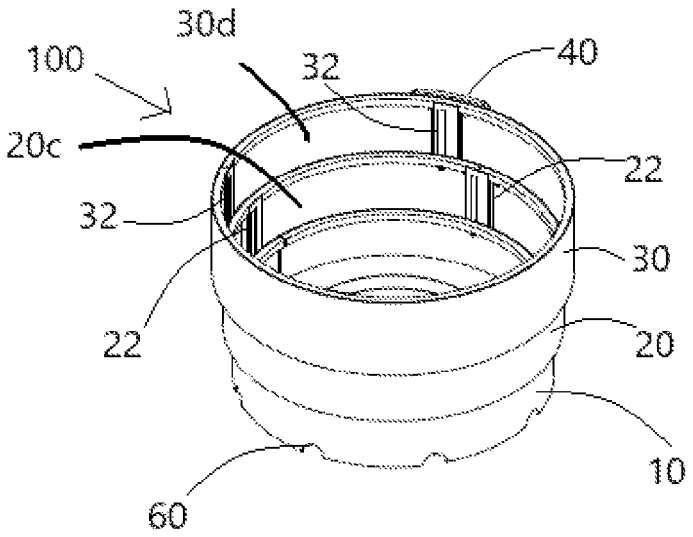
FIG. 1 is a perspective view of the present invention in an expanded position.
Figure 2:
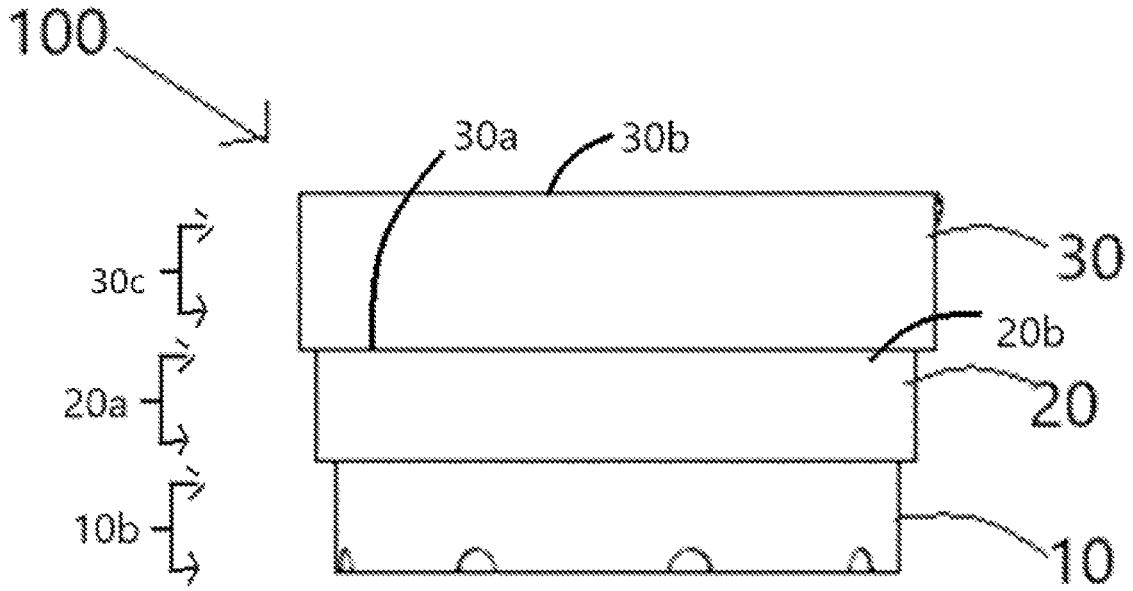
FIG. 2 is a front view of the present invention.
Figure 3:
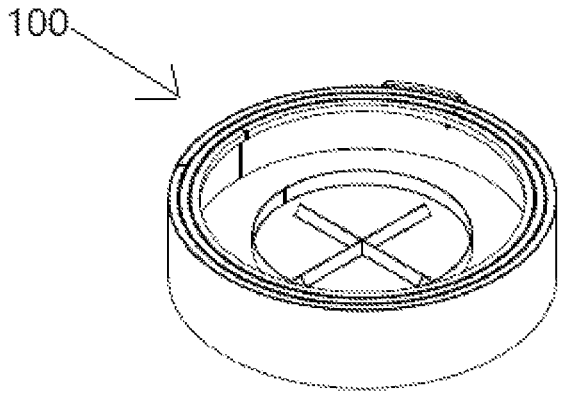
FIG. 3 is a perspective view of the present invention in a collapsed position.
Figure 4:
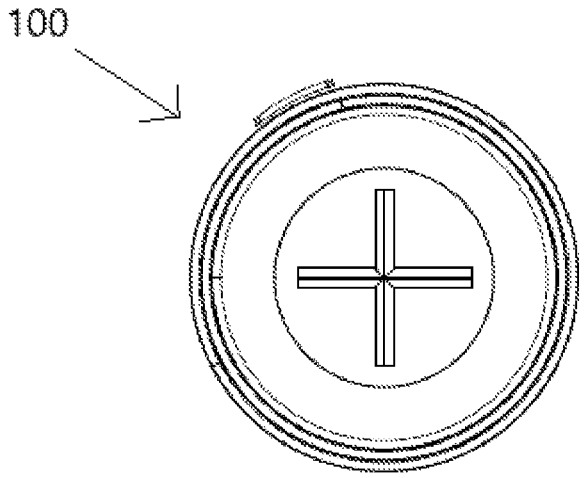
FIG. 4 is a top plan view of the present invention.
Figure 5:
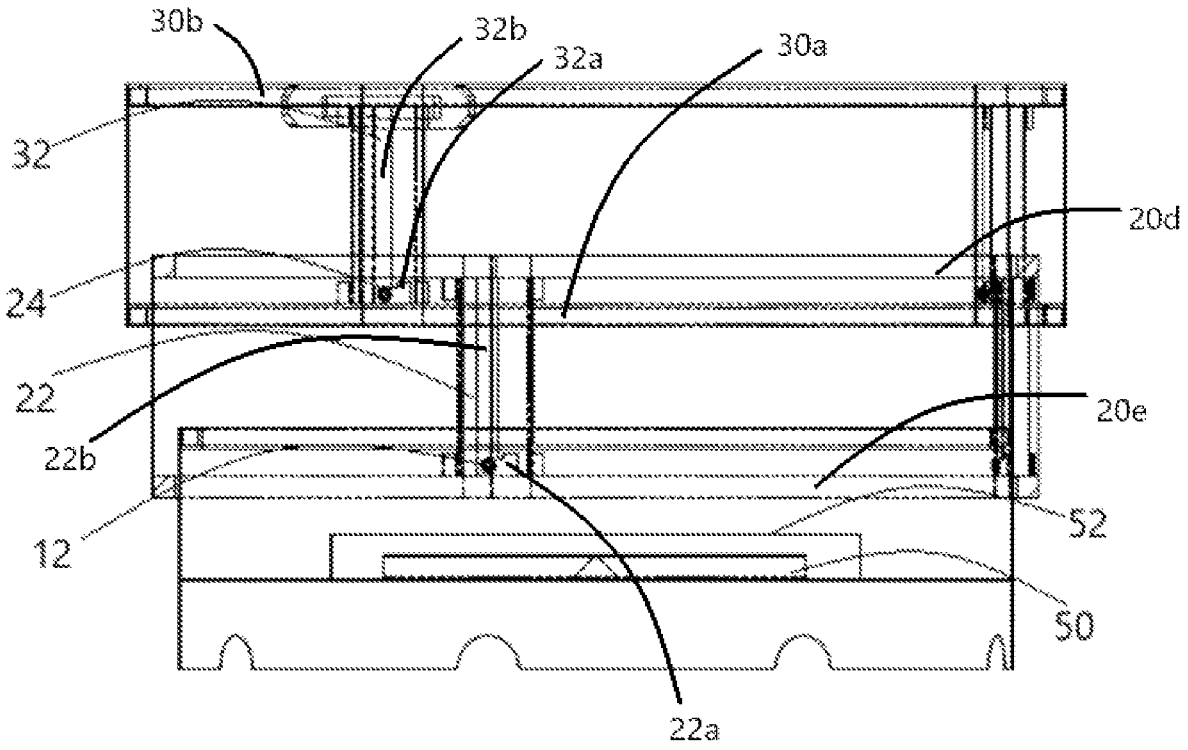
FIG. 5 is a sectional view of the present invention.

As seen in FIGS. 1-5, the present invention is a collapsible fire pit 100 that is easy to transport.

The collapsible fire pit 100 comprises a ring base 10 has a base 10*a* and an outer wall 10*b* that extends upward from a circumference of the ring base10, the outer wall 10*b* of the ring base measures at least three inches in height, at least three pins 12 that are defined on an upper section of the outer wall of the ring base 10, the at least three pins 12 are equally spaced around the circumference of the outer wall 10*b* of the ring base 10. A first annular ring 20 that extends upward from the ring base 10, the first annular ring 20 has an outer wall 20*a* that measures at least three inches in height, the first annular ring 20 has a top side 20*d* and a bottom side 20*e*, the first annular ring 20 has a circumference that is larger than an outer wall 10*b* of the ring base 10, an inner wall 20*c* of the first annular ring 20 defines at least three L-shaped guides 22, the L-Shaped guides 22 are positioned so that a horizontal part 22*a* of the L-shaped guides 22 run adjacently to the bottom side 20*e* of the first annular ring 20 and a vertical part 22*b* of the L-shaped guides 22 runs upward from the bottom side 20*e* of first annular ring 20 toward the top side 22*d* of the first annular ring 20, the vertical part 22*b* of the L-Shaped guides 22 do not pass through the top side 20*d* of the first annular ring 20, a top side 20*b* of the outer wall 20*a* of the first annular ring 20 has at least three pins 24 that are equally spaced around the circumference of the first annular ring 20, and each L-shaped guide 22 of the at least three L-shaped guides 22 receives each pin 12 of the ring base 10. And, a second annular ring 30 that extends upward from the first annular ring 20, the second annular ring has a top side 30*b* and a bottom side 30*a*, the second annular ring 30 has an outer wall 30*c* that measures at least three inches in height, the second annular ring 30 has a circumference that is larger than the outer wall 20*a* of the first annular ring 20, an inner wall 30*d* of the second annular ring 30 defines at least three L-shaped guides 32, the L-Shaped guides are positioned so that a horizontal part 32*a* of the L-shaped guides 32 run adjacently to the bottom side 30*a* of the second annular ring 30 and a vertical part 32*b* of the L-shaped guides 32 runs upward from the bottom side 30*a* of the second annular ring 30 toward the top side 30*b* of the second annular ring 30, the vertical part 32*b* of the L-Shaped guides 32 do not pass through the top side 30*b* of the second annular ring, and each L-shaped guide 32 of the at least three L-shaped guides 32 receives each pin 24 of the first annular ring 20.

In an embodiment of the present invention, the second annular ring 30 defines at least one handle 40.

In embodiments of the present invention, the collapsible fire pit comprises of an elevated ash pan 50 that is removably attached to the ring base 10, and a screen tray 52 that is placed on the elevated ash pan 50.

In another embodiment of the present invention, the ring base 10 further defines a plurality of air flow apertures 60 around the circumference of the ring base 10.

In preferred embodiments, the ring base 10, the first annular ring 20, and the second annular ring 30 are made of a rigid fireproof material.

An advantage of the present invention is that it provides a collapsible travel pit that is easily be stored in a vehicle.

Another advantage of the present invention is that it provides a collapsible fire pit that serves as an emergency stove.

Yet another advantage of the present invention is that it provides a collapsible fire pit that stows in a backpack.

Yet still another advantage of the present invention is that it provides a tactical collapsible fire pit that military personnel can use when on clandestine missions.

A further advantage of the present invention is that it provides a collapsible fire pit that lays flat in a transport vehicle and that does not flip while in transport.

Yet a further advantage of the present invention is that it provides a collapsible fire pit that prevents animals from getting injured when they inadvertently touch the outer walls of the pit.

Yet still a further advantage of the present invention is that it allows a camper to have a fire pit that he can easily transport and stow after use that will not soil his transport vehicle.

The embodiments of the collapsible fire pit described herein are exemplary and numerous modifications, combinations, variations, and rearrangements can be readily envisioned to achieve an equivalent result, all of which are intended to be embraced within the scope of the appended claims. Further, nothing in the above-provided discussions of the collapsible fire pit should be construed as limiting the invention to an embodiment or a combination of embodiments. The scope of the invention is defined by the description, drawings, and claims.

What is claimed is:

1. A telescopic fire pit that is easy transport, the telescopic fire pit comprises:

a ring base has a base and an outer wall that extends upward from a circumference of the ring base, the outer wall of the ring base measures at least three inches in height, at least three pins that are defined on an upper section of the outer wall of the ring base, the at least three pins are equally spaced around the circumference of the outer wall of the ring base;

a first annular ring that extends upward from the ring base, the first annular ring has an outer wall that measures at least three inches in height, the first annular ring has a top side and a bottom side, the first annular ring has a circumference that is larger than an outer wall of the ring base, an inner wall of the first annular ring defines at least three L-shaped guides, the L-Shaped guides are positioned so that a horizontal part of the L-shaped guides run adjacently to the bottom side of the first annular ring and a vertical part of the L-shaped guides runs upward from the bottom side of first annular ring toward the top side of the first annular ring, the vertical part of the L-Shaped guides do not pass through the top side of the first annular ring, a top side of an outer wall of the first annular ring has at least three pins that are equally spaced around the circumference of the first annular ring, and each L-shaped guide of the at least three L-shaped guides receives each pin of the ring base; and a second annular ring that extends upward from the first annular ring, the second annular ring has a top side and a bottom side, the second annular ring has an outer wall that measures at least three inches in height, the second annular ring has a circumference that is larger than the outer wall of the first annular ring, an inner wall of the second annular ring defines at least three L-shaped guides, the L-Shaped guides are positioned so that a horizontal part of the L-shaped guides run adjacently to the bottom side of the second annular ring and a vertical part of the L-shaped guides runs upward from the bottom side of the second annular ring toward the top side of the second annular ring, the vertical part of the L-Shaped guides do not pass through the top side of the second annular ring, and each L-shaped guide of the at least three L-shaped guides receives each pin of the first annular ring.

2. The telescopic fire pit that is easy to transport of claim 1, wherein the second annular ring defines at least one handle.

3. The telescopic fire pit that is easy to transport of claim 2, the telescopic fire pit comprises an elevated ash pan that is removably attached to the ring base, and a screen tray that is placed on the elevated ash pan.

4. The telescopic fire pit that is easy to transport of claim 3, wherein the ring base further defines a plurality of air flow apertures around the circumference of the ring base.

5. The telescopic fire pit that is easy to transport of claim 4, wherein the ring base, the first annular ring, the second annular ring, and the cover are made of a rigid fireproof material.

* * * * *